United States Patent [19]

Blaese

[11] 4,282,531

[45] Aug. 4, 1981

[54] VERTICAL ANTENNA WITH UPWARDLY FLARING BASE MOUNTED CONDUCTORS

[75] Inventor: Herbert R. Blaese, Chicago, Ill.

[73] Assignee: Avanti Research & Development, Inc., Addison, Ill.

[21] Appl. No.: 109,494

[22] Filed: Jan. 4, 1980

[51] Int. Cl.[3] ..... H01Q 9/32

[52] U.S. Cl. ..... 343/791; 343/830; 343/846

[58] Field of Search ..... 343/790, 791, 792, 829, 343/830, 846, 900

[56] References Cited

U.S. PATENT DOCUMENTS

| | | | |
|---|---|---|---|
| 2,184,771 | 12/1939 | Roosenstein | 343/830 |
| 3,048,845 | 8/1962 | Becker | 343/790 |
| 3,587,109 | 6/1971 | Martino | 343/792 |
| 4,095,231 | 6/1978 | Carter | 343/846 |

*Primary Examiner*—Eli Lieberman

*Attorney, Agent, or Firm*—Dressler, Goldsmith, Shore, Sutker & Milnamow, Ltd.

[57] ABSTRACT

A communications antenna is disclosed having improved mechanical strength, gain and reduced lateral dimensions. The antenna includes a three quarter wave length vertically disposed elongated radiating element and a plurality of one-quarter wave length diverging elements connected at their bottom end to the bottom of the vertical radiator. The diverging elements flare upwardly and outwardly from the radiator at an acute angle, typically between about five degrees and about thirty degrees. The band width of the antenna may be broadened by interconnecting the free ends of the diverging elements such as by a conductive hoop.

19 Claims, 3 Drawing Figures

FIG. 1
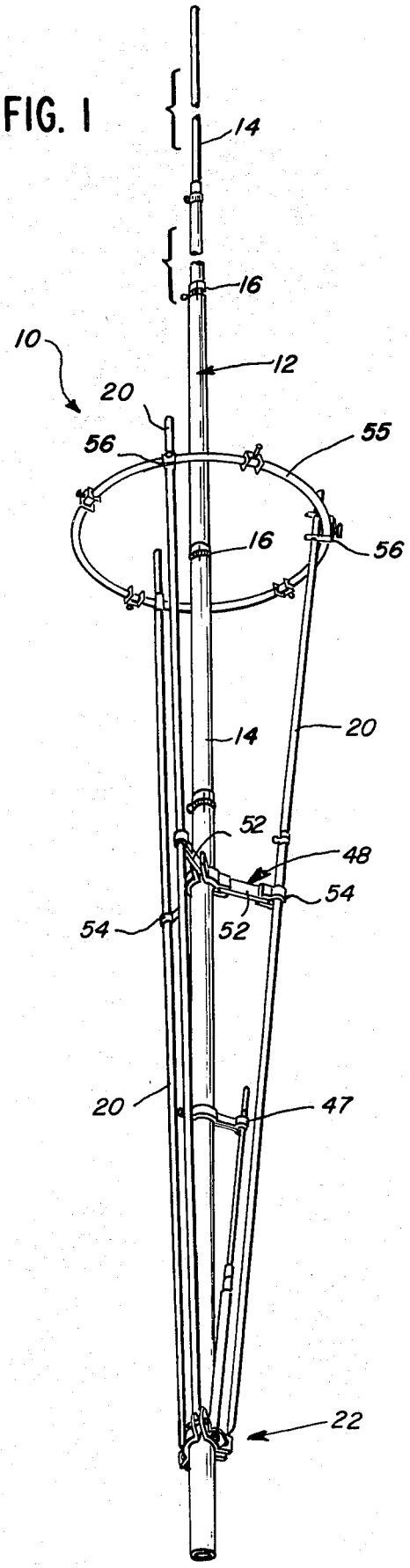
FIG. 2
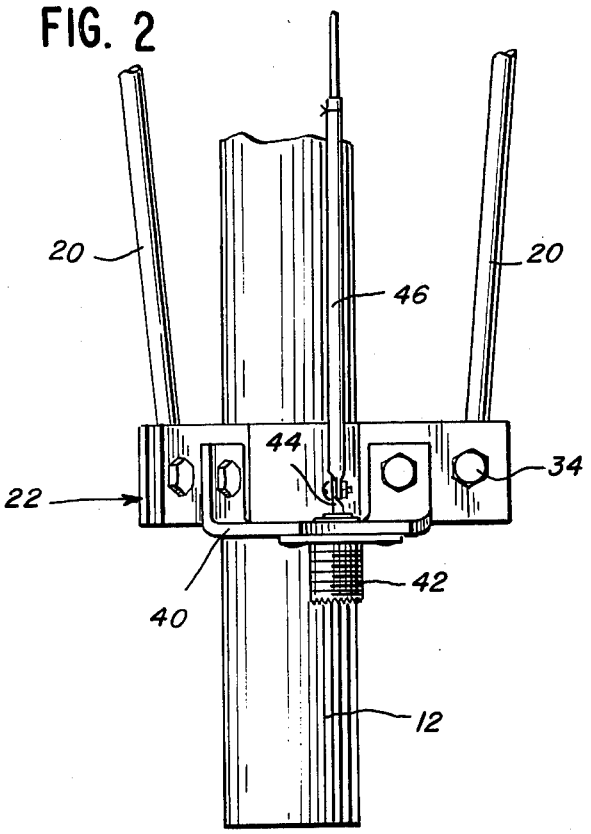
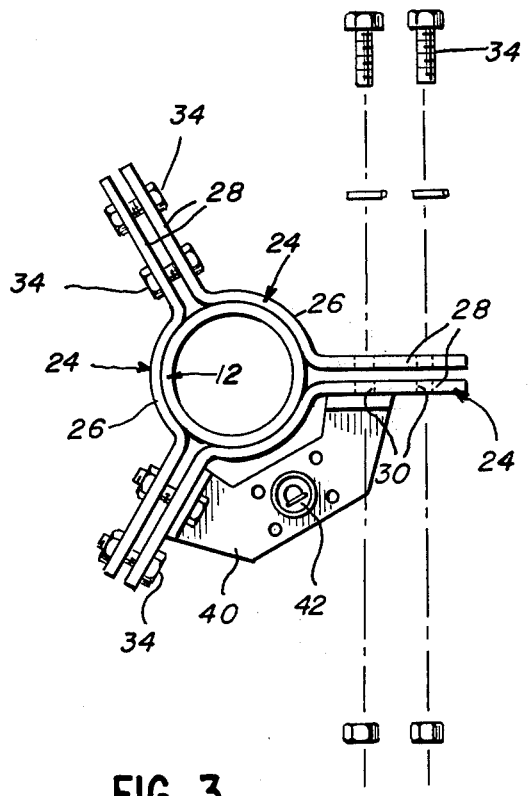
FIG. 3

VERTICAL ANTENNA WITH UPWARDLY FLARING BASE MOUNTED CONDUCTORS

TECHNICAL FIELD OF THE INVENTION

This invention relates to communication antennas for two way radio communication, and in particular to antennas for base station installations which may be conveniently dimensioned for use in the frequency ranges including the 27 megahertz citizens band (commonly referred to as "CB").

BACKGROUND OF THE INVENTION

The radio antenna is the link between a transmitter/-receiver and the outside world. The importance of an antenna having good radiation characteristics cannot be overemphasized. This is particularly true for CB applications in which the power of the CB transmitter is quite limited, by law, and in which substantially all transmitters are designed to operate at maximum legal power.

One good way, therefore, to increase the effectiveness of transmission is to utilize an antenna which radiates efficiently. The capability of an antenna and the efficiency with which it radiates is typically referred to as the gain of an antenna. In discussing gain, it is common to use a reference for comparison. One such reference is a half-wave dipole antenna. Thus, the gain of an antenna is often characterized by comparing its radiation pattern to that of the reference—a half-wave dipole antenna.

It is of course evident that the higher the gain of an antenna the more efficient and effective will be its transmission characteristics, assuming of course proper impedance matching with the transmission line.

Antennas may also be characterized by their directivity, being either omni-directional or directional. One technique utilized to increase the gain of an antenna is to focus its radiation pattern, i.e., make it directional. Such "beam" antennas do exhibit high gain in their direction of maximum radiation. This gain is obtained by "focusing" the radiation pattern in one direction, and by reducing sensitivity in directions other than the preferred direction. These directional antennas are typically utilized with antenna rotors in order to permit communications in different directions.

The size of such directional antennas, particularly for use in CB operations, is quite large and such antennas are also expensive. For this reason, and because directivity is not usually desired, omni-directional antennas are used in a large majority of the installations of base station antennas. The most common of these antennas include quarter-wave and five-eighths wave ground plane antennas, and half wave antennas.

It is generally recognized, that of the commonly used CB omni-directional vertical antennas, the five-eighths wave provides the most gain. For example, compared to a half-wave dipole, a quarter-wave ground plane antenna has a lower gain, −1.8 dB, while a five-eighths wave antenna has a higher gain, +1.2 dB. Extending the length of the antenna beyond five-eighths wave does not, as a practical matter, produce greater gain and, in fact a three-quarter wave antenna has less gain than the half-wave dipole reference.

One of the problems associated with quarter-wave and five-eighths wave antennas is the need for a ground plane. Particularly in CB operations, such a ground plane is typically provided by quarter-wave radially extending elements. In the CB range, these elements are approximately nine feet long and, therefor these antennas require sustantial lateral or horizontal space, more than 18 feet, as can be appreciated. These ground plane antennas are also strongly affected by the surrounding environment such as buildings, guy wires, and other interfering masses.

It would be desirable, therefore, to be able to provide an omni-directional antenna with improved gain characteristics while simultaneously minimizing the space requirements for such an antenna. Such an antenna would then provide good gain characteristics with minimum space requirements. Furthermore, if such an antenna could be built relatively simply and inexpensively, there would result a highly desirable and usable product.

SUMMARY OF THE INVENTION

In accordance with the present invention there is provided a simple, efficient omnidirectional antenna exhibiting excellent radiation gain characteristics and requiring minimum space for installation.

The antenna incorporating the present invention reduces by about fifty to eighty-five percent the lateral or radial space required as compared to a quarter-wave of five-eighths wave ground plane antenna while simultaneously providing better gain than a five-eighths vertical antenna.

The improved high gain omni-directional antenna incorporating the present invention embodies a vertical elongated radiating element typically having a length of about three-quarter wave length connected to a transmission line, e.g., adjacent its lower end through a suitable impedance matching circuit such as a gamma match. The length of the radiating element can be increased in discrete increments if desired.

This antenna includes diverging element means having an electrical length of about one-quarter wave length connected at one end to the lower end of the vertical radiator and extending upward from the lower end of the three-quarter wave radiator and at an acute angle thereto. The diverging element means typically takes the form of a plurality of uniformly spaced elongated elements, although other configurations, such as a conical member can be used.

The antenna of the present invention incorporates both the advantage of minimizing the lateral or radial dimensions of the antenna and the advantage of obtaining increased gain characteristics. The improved radiation characteristics and size reduction can be advantageously obtained when the acute angle between the diverging elements and the vertical radiator is between about five degrees and about 30 degrees, although in some cases angles larger than 30 degrees also produce improved gain.

In one disclosed embodiment for use in the C.B. band, the maximum radial dimension between the antenna radiator and the diverging elements is about fifteen inches. This embodiment of the antenna exhibits a gain, when compared to a half wave dipole, of about 2.2 dB. At somewhat greater angles, where the radial dimensions are of course larger, e.g., an angle of approximately thirty degrees where the radial dimension is about four and one-half feet, the gain over a half-wave dipole antenna is about 2.7 dB.

Advantageously, the antenna incorporating the present invention is simple, strong, structurally sound, and utilizes a minimum number of insulators. If the feed point, the point at which the transmission line is connected to the antenna structure, is located where all of the components are structurally affixed one to the other, the transmission line connector provides the necessary isolation and the result is a substantially stronger assembly.

Furthermore, by utilizing a transverse element such as a conductive ring interconnecting the ends of the diverging element means, the band width of the antenna in terms of maintaining a low standing wave ratio (S.W.R.) as a function of frequency, can be extended while simultaneously shortening the physical length and therefore the maximum radial dimension of the diverging elements.

From the foregoing, it will be observed that numerous variations and modifications may be effected without departing from the true spirit and scope of the novel concept of the present invention. It is, of course, intended to cover by the appended claims all such modifications as fall within the scope of the claims.

BRIEF DESCRIPTION OF THE DRAWINGS

FIG. 1 shows an antenna incorporating the present invention;

FIG. 2 is an enlarged partial side view showing a support clamp for attaching the diverging radials; and FIG. 3 is a top view of the clamp shown in FIG. 2.

DESCRIPTION OF PREFERRED EMBODIMENT

While this invention is susceptible of embodiment in many different forms, there is shown in the drawing and will herein be described in detail one specific embodiment, with the understanding that the present disclosure is to be considered as an exemplification of the principles of the invention and is not intended to limit the invention to the embodiment illustrated. The scope of the invention will be pointed out in the appended claims.

The antenna assembly 10 of the present invention as shown in the drawing, includes an elongated radiating element 12 designed to be installed in a vertical plane. The radiating element 12 has an electrical length of about three-quarters wave length at the frequency at which the antenna is tuned, e.g., approximately 27 feet for an antenna designed for use in the CB band. For convenience in shipment, the antenna radiator 12 is formed of a plurality of telescoping sections 14 which fit one inside the other and which may be extended to their desired length and clamped in place by suitable clamping members 16.

The antenna assembly 10 of the present invention also includes diverging element means shown as a plurality of uniformly spaced diverging elements 20, there being three shown in the drawing. The elements 20 are fastened at their lower ends to the lower end of the vertical radiator 12 and are electrically connected thereto.

The lower ends of the elements 20 are connected to the vertical radiator 12 by means of a three piece split clamp 22. Clamp 22 includes three elements 24 each having an arcuate center portion 26 adapted for surface-to-surface contact with the base of the radiator 12. Flanges 28 extend radially out from center portion 26 and when assembled, from the vertical radiator 12 as well. Each of the flanges 28 is provided with two radially spaced apertures 30. The inward aperture 30 is adapted to receive a fastener 34 such as a nut and bolt assembly passing through the flanges 28 of adjacent elements 24 to fasten them together and to tighten the clamp 22 on the radiator 12. The lower ends of the elements 20 may be flattened to fit between adjacent flanges 28 and are fastened thereto by the fasteners 34 passed through the outer aperture 30.

When the transmission line is to be connected to the antenna adjacent its lower end, a connector plate 40 is fastened between the flanges 28 of one of the clamps 24. In the center of the connector plate 40 there is provided a connector 42 adapted to receive a mating connector from a transmission line, typically a coaxial cable (not shown). The outer portion of the connector 42 is electrically connected to the connector plate 40 and thereby to the base of the antenna radiator 12 and to the lower ends of the elements 20, while the center pin 44 connected to one end of an impedance matching assembly such as a gamma match 46. The other end of the gamma match 46 is connected to the radiator 12 at an appropriate point 47 to match the impedance of the antenna 10 to the impedance of the transmission line. It should be appreciated that other connection points between the antenna and the transmission line may be utilized.

The elements 20 diverge or flare upwardly and outwardly from the vertical radiator 12 at an acute angle thereto. In the embodiment shown in the drawing, the angle between the diverging elements 20 and the vertical radiator 12 is approximately ten degrees. It has been found, that improved gain characteristics are obtained while simultaneously reducing the radial dimension of the antenna when the included angle between the vertical radiator 12 and the elements 20 is between about five degrees and about thirty degrees. While gain improvements can sometimes result when the angle is somewhat greater than about thirty degrees, the benefits of reduced lateral dimensions are minimized at these greater angles.

The diverging elements 20 are supported intermediate their ends by a support bracket 48. The support bracket 48 includes a three-piece clamp 50 somewhat similar in general configuration to the clamp 22. An insulated extension 52 is connected to the flanges of the clamp 50 thereby to insulate the elements 20 from radiation 12 thereof. The other end of each insulator 52 is connected to a U-shaped clamp 54 through which one of the elements 20 is passed.

The electrical length of the diverging elements 20 is one-quarter wave length which is about nine feet for antennas designed for use in the CB band. In order to broaden the band width of the antenna in terms of maintaining a low-standing wave ratio (S.W.R.) as a function of frequency, a conductive hoop or ring 55 is affixed to the free ends of the elements 20 via suitable mechanical connectors 56. The use of the ring 55 not only broadens the band width of the antenna 10 but also effectively reduces the physical length of the elements 20 to maintain their one-quarter wave electrical length.

For example, in the illustrated embodiment, the length of the elements without the ring would be approximately 107 inches, whereas with the addition of the ring 55, the length of the elements 20 is about 89½ inches. Thus the ring further reduces the length of elements 20 and therefore the lateral or radial dimension of the antenna assembly 10.

In one embodiment, an antenna such as disclosed in the drawing—having an overall length of about 328 inches, with elements having a length of about 89½ inches, and with the ends of the elements connected to a conductive ring have a diameter of about 29½ inches—exhibited a gain when compared to a five-eighths wave antenna of about one. Since five-eighths waves antennas have a gain when compared to a half-wave length dipole of approximately 1.2, the gain of this embodiment when compared to a half-wave dipole is approximately 2.2.

At an angle of about 30 degrees, where the distance between the tips of the diverging elements 20 would be about nine feet, the gain of the antenna incorporating the present invention is about 2.8 as compared to a half-wave dipole.

Thus, the antenna of the present invention provides both physical and electrical advantages. The lateral dimensions of the antenna can be reduced while its gain is simultaneously enhanced. Furthermore, significant structural connections are metal-to-metal to improve the strength and rigidity of the assembly.

From the foregoing, it will be observed that numerous variations and modifications may be effected without departing from the true spirit and scope of the novel concept of the present invention. It is, of course, intended to cover by the appended claims all such modifications as fall within the scope of the claims.

What is claimed is:

1. A two-way communications antenna comprising:
an elongated radiating element having an electrical length of about three-quarters wave length; and
diverging element means connected at one end to said radiating element adjacent an end thereof and extending therefrom towards the other end of said radiating element and at an acute angle thereto, said diverging element means having an effective electrical length of about one-quarter wave length.

2. An antenna as claimed in claim 1 wherein:
the acute angle included between said diverging element means and said radiating element is between about five degrees and about thirty degrees.

3. An antenna as claimed in claim 2 wherein:
said acute angle included between said radiating element and said diverging element means is about ten degrees.

4. An antenna as claimed in claim 1 wherein:
said radiating element is oriented in a vertical plane, and in which the bottom end of said radiating element and the bottom end of said diverging element means are electrically connected together.

5. An antenna as claimed in claim 1 including:
an electrically conductive member interconnecting the free ends of said diverging element means and extending about and around said radiating element.

6. An antenna as claimed in claims 1, 2, 3, 4 or 5 wherein:
said diverging element means comprises a plurality of elongated diverging elements each connected at one end to said radiating element adjacent said end thereof.

7. An antenna as claimed in claim 6 wherein:
said diverging elements are uniformly spaced circumferentially around said radiating element.

8. A two-way communications antenna assembly for use in the CB band comprising:
an elongated radiating element adapted to be supported in a vertical plane and having a length of about 27 feet equal to about three-quarters wave length;
a plurality of diverging elements mechanically and electrically connected at their lower ends to said radiating element and extending upwardly and outwardly therefrom at an acute angle thereto, said diverging elements having a length of about one-quarter wave length at the center of the CB band; and
means for connecting a transmission line to said antenna assembly.

9. An antenna as claimed in claim 8, wherein:
said transmission line connecting means includes means for connecting one conductor of a two-wire transmission line to said radiating element and for connecting the other conductor of the transmission line to the base of said radiating element and to said diverging elements including an impedance matching circuit for matching the impedance of said antenna to the impedance of said transmission line.

10. An antenna as claimed in claim 8 including:
a conductive member spaced from and disposed in a plane generally transverse to said radiating element and interconnecting said diverging elements at the free ends thereof;
the length of said diverging elements terminating at said conductive member having a physical length less than their electrical length.

11. An antenna as claimed in claim 10 wherein:
said conductive member is curvilinear in shape and the ends of said diverging elements are spaced from said radiating element by a distance of about 15 inches.

12. An antenna as claimed in claim 11 wherein:
said diverging elements have a length of about 90 inches.

13. An antenna as claimed in claim 8 wherein:
the included angle between said radiating element and each said diverging element is between about 5° and about 30°.

14. An antenna as claimed in claim 8 wherein:
the included angle between said radiating element and each said diverging element is about 10°.

15. An antenna as claimed in claim 8 wherein:
said diverging elements are three in number.

16. A two-way communications antenna comprising:
an elongated radiating element having an electrical length of about three-quarters wave length; and
diverging element means supported at one end thereof adjacent an end of said radiating element and extending therefrom towards the other end of said radiating element and at an acute angle thereto, said diverging element means having an effective electrical length of about one-quarter wave length.

17. An antenna as claimed in claim 16, wherein:
said diverging element means comprises a plurality of elongated diverging elements electrically connected together at said one end thereof.

18. An antenna as claimed in claim 17, wherein:
said one end of each of said diverging elements is electrically connected to said radiating element adjacent said one end thereof.

19. An antenna as claimed in claims 17 or 18, wherein:
said diverging elements are uniformly spaced circumferentially around said radiating element.

* * * * *